US007421934B1

(12) United States Patent
Madulka et al.

(10) Patent No.: US 7,421,934 B1
(45) Date of Patent: Sep. 9, 2008

(54) MORTAR TUBE FOR TRAINING

(75) Inventors: KarolAnne Madulka, Ballston Spa, NY (US); Richard Becker, Gloversville, NY (US); George E. Hathaway, IV, Spreakers, NY (US); Mark Witherell, Wynantskill, NY (US); Steve Tauscher, Schuylerville, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 47 days.

(21) Appl. No.: 11/467,265

(22) Filed: Aug. 25, 2006

Related U.S. Application Data

(60) Provisional application No. 60/596,128, filed on Sep. 1, 2005.

(51) Int. Cl.
*F41A 21/00* (2006.01)

(52) U.S. Cl. ..... 89/29; 102/445; 102/446; 42/77

(58) Field of Classification Search ..... 102/444, 102/445, 446, 447; 89/37.05, 29; 42/77
See application file for complete search history.

(56) References Cited

U.S. PATENT DOCUMENTS

| | | | | | |
|---|---|---|---|---|---|
| 353,231 | A * | 11/1886 | Morris | 89/29 |
| 741,079 | A * | 10/1903 | Tasker | 89/29 |
| 745,464 | A * | 12/1903 | Tasker | 89/29 |
| 754,412 | A * | 3/1904 | Bevans | 89/29 |
| 757,790 | A * | 4/1904 | Tasker | 89/29 |
| 3,274,935 | A * | 9/1966 | Gawlick et al. | 102/445 |
| 3,276,374 | A * | 10/1966 | Gawlick et al. | 102/445 |
| 3,638,571 | A * | 2/1972 | Gawlick et al. | 102/444 |
| 3,745,879 | A * | 7/1973 | Asikainen et al. | 89/37.05 |
| 4,098,190 | A * | 7/1978 | Gawlick et al. | 102/445 |
| 4,549,487 | A * | 10/1985 | Jensen | 102/498 |
| 4,711,180 | A * | 12/1987 | Smolnik | 102/445 |
| 4,955,300 | A * | 9/1990 | Bertiller et al. | 102/446 |
| 5,463,958 | A * | 11/1995 | Roheim | 102/445 |
| 6,059,573 | A * | 5/2000 | Patel | 434/16 |
| 6,145,440 | A * | 11/2000 | Franzen | 102/446 |
| 6,202,533 | B1 * | 3/2001 | Reynolds et al. | 89/29 |
| 2007/0221051 | A1 * | 9/2007 | Burkholder et al. | 89/1.35 |

* cited by examiner

*Primary Examiner*—Michael J. Carone
*Assistant Examiner*—Daniel J Troy
(74) *Attorney, Agent, or Firm*—John F. Moran

(57) ABSTRACT

A training mortar apparatus includes a small mortar tube and a large mortar tube, the small mortar tube being disposed in the large mortar tube; a removable base cap attached to one end of the small mortar tube; a plug inserted in the removable base cap; a removable firing pin inserted in the plug; a second base cap attached to one end of the large mortar tube; and at least one opening in the large mortar tube, the opening being axially aligned with the removable firing pin of the small mortar tube. Improved manufacturing methods are also disclosed.

11 Claims, 1 Drawing Sheet

MORTAR TUBE FOR TRAINING

CROSS-REFERENCE TO RELATED APPLICATIONS

This application claims the benefit under 35 USC 119(e) of U.S. provisional patent application 60/596,128 filed on Sep. 1, 2005, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar munitions and in particular to a mortar tube for training purposes.

The world's militaries make large monetary and resource outlays to train soldiers to use mortar systems, such as the 120 mm mortar. Additional amounts are dedicated to ammunition. It is possible to reduce such costs by utilizing cheaper training ammunition, for example, by substituting 81 mm training ammunition for the more expensive 120 mm training ammunition. This has resulted in a large cost savings, e.g., $35million.

The current 81 mm training ammunition is being rapidly depleted and will be completely exhausted in the near future. The U.S. military has chosen to replace this training ammunition with more advanced ammunition. The current 120 mm sub-caliber training inserts are not designed to handle the pressures of the new series of training ammunition. The current operating pressure is about 8800 psi, as compared to 12,000 psi for the new training ammunition.

SUMMARY OF THE INVENTION

It is an object of the invention to provide a training apparatus for mortars that can handle both the current training mortar rounds and the newer higher-pressure mortar rounds.

It is another object of the invention to provide a training apparatus for mortars that is safer than the known devices.

It is a further object of the invention to provide a training apparatus for mortars that is cheaper to make than the known devices.

Still another object of the invention is to provide a training apparatus for mortars that replicates a larger caliber mortar while using smaller caliber rounds.

One aspect of the invention is a training mortar apparatus comprising a small mortar tube and a large mortar tube, the small mortar tube being disposed in the large mortar tube; a removable base cap attached to one end of the small mortar tube; a plug inserted in the removable base cap; a removable firing pin inserted in the plug; a second base cap attached to one end of the large mortar tube; and at least one opening in the large mortar tube, the opening being axially aligned with the removable firing pin of the small mortar tube.

The small mortar tube preferably includes an integral blast attenuation device. The training apparatus may further comprise a centering ring disposed around the small mortar tube adjacent a muzzle end of the large mortar tube. In one embodiment, the number of openings in the large mortar tube that are axially aligned with the removable firing pin is three. The large mortar tube also includes a seat for the plug of the small mortar tube.

Another aspect of the invention is a method of making a mortar tube comprising forging the mortar tube to include an integral blast attenuation device. The method further comprises forming a base cap that is separate from the mortar tube. The base cap is preferably formed with integral centering projections. The method further includes machining the interior of the mortar tube without having a base cap attached to the mortar tube.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention comprises a larger caliber mock tube and a smaller caliber mortar barrel. In one embodiment, the larger caliber mock tube is a 120 mm tube and the smaller caliber mortar barrel is a 81 mm barrel. Of course, other sizes may be used. The larger caliber mock tube replicates the form and fit of an operational 120 mm mortar system with added window cutout elements or openings. The window elements provide safe firing pin removal of the 81 mm firing pin during improper firing operation, e.g., hang fires.

The present invention eases the safety problem in the prior art system. In the prior art, an 81 mm mortar round is placed inside an actual 120 mm mortar barrel assembly. Once the round is placed in the 120 mm tube, there is no way to access the firing pin because it is blocked by the 120 mm tube. The safety problem occurs because the firing pin goes through the bottom of the ball in the base cap. If a round misfires, safe removal of the round requires that the soldier pull the mortar round out of the 120 mm mortar tube. However, because the firing pin is still engaged while this procedure is being performed, the round could dislodge and hit the firing pin while the soldier is handling the tube. With prior art mortars, this safety problem has resulted in mortar operation fatalities during a hang fire because the firing pin could not be removed. The invention permits the operator, e.g., soldier, to positively verify that the firing pin has been removed in the event of a misfire.

Figure 1:
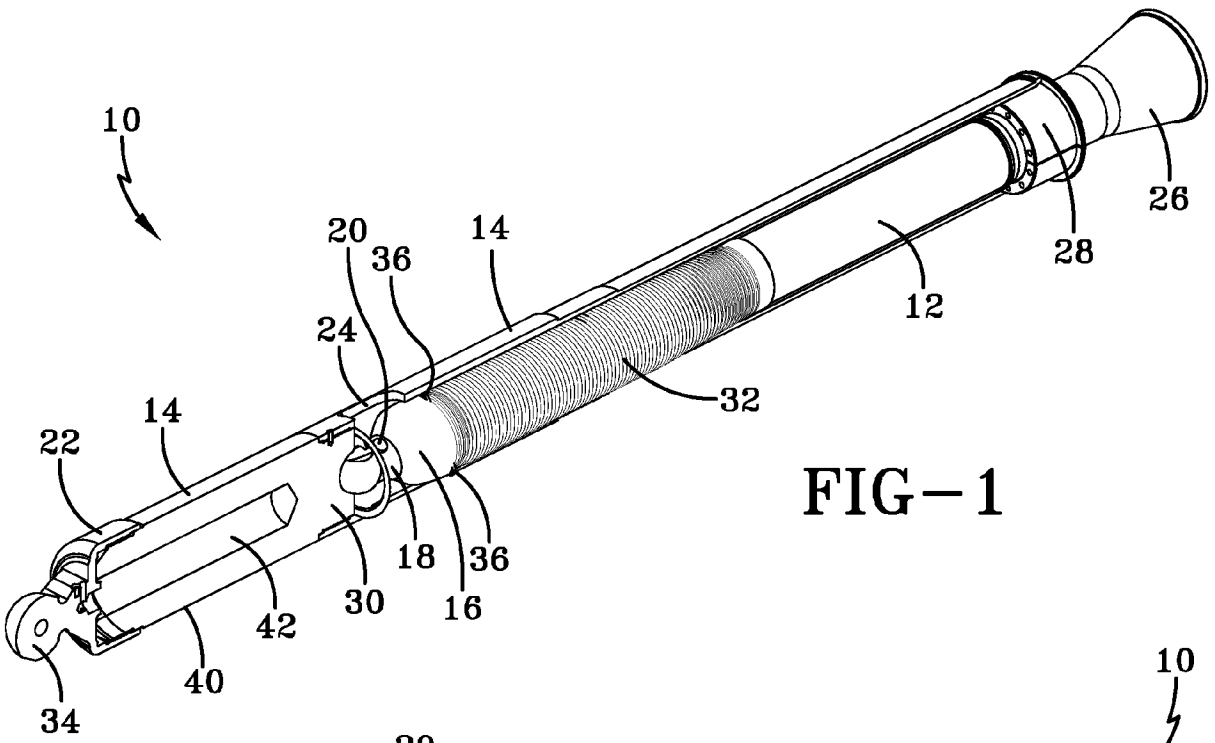
FIG. 1 is a cutaway perspective view of one embodiment of the invention.
Figure 2:
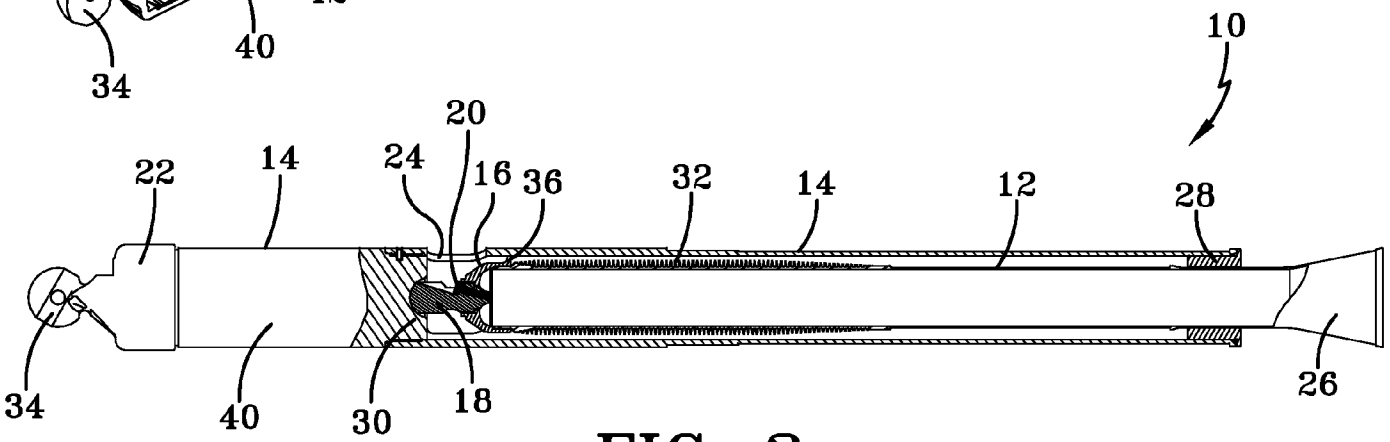
FIG. 2 is a sectional view of FIG. 1.

FIG. 1 is a cutaway perspective view of one embodiment of the invention and FIG. 2 is a sectional view of FIG. 1. A training mortar apparatus 10 includes a small mortar tube 12 disposed inside a large mortar tube 14. The terms "small" and "large" refer to the diameters Page 4 of 11 of the tubes 12, 14. In one preferred embodiment, the small tube 12 is an 81 mm tube and the large tube 14 is a 120 mm tube. A removable base cap 16 is attached by, for example, threads, to one end of the small mortar tube 12. A plug 18 is inserted in the removable base cap 16 and a removable firing pin 20 is inserted in the plug 18. Plug 18 may be threaded into base cap 16 and firing pin 20 may be threaded into plug 18. A second base cap 22 is attached by, for example, threads, to one end of the large mortar tube 14.

The large mortar tube 14 includes at least one opening or window 24 that is axially aligned with the removable firing pin 20 of the small mortar tube 12. In one preferred embodiment, the number of openings 24 is three, spaced circumferentially around the tube 14. The openings 24 provide for safe firing pin removal during misfires. The openings or window elements 24 are an important safety feature of the invention.

The small mortar tube 12 includes an integral blast attenuation device (BAD) 26. A centering ring 28 is disposed around the small mortar tube 12 adjacent a muzzle end of the large mortar tube 14. The centering ring 28 may comprise two split rings that are placed around the small tube 12. Small mortar tube 12 includes cooling fins 32 formed thereon. The removable base cap 16 of the small mortar tube 12 includes centering projections 36. In one embodiment, the number of centering projections 36 is three. The small mortar tube 12 is made of, for example, high strength steel. The small mortar tube 12 with the separate/removable base cap 16, BAD 26, plug 18 and firing pin 20 may also be used as a stand-alone conventional 81 mm mortar weapon.

The large mortar tube 14 includes a seat 40 with a front portion 30 formed to receive the plug 18 of the small mortar tube 12. Seat 40 provides the support for small tube 12. The seat 40 may be formed in a variety of ways. Seat 40 may be a separate tubular or solid cylindrical piece that is threaded onto the main portion of tube 14, as shown in FIG. 2. Or, seat 40 may be a tubular or solid insert that extends from the rear of the large tube 14 to the position of the plug 18. To save weight, the seat 40 may include an interior void space 42, as shown in FIG. 1. The seat 40 must be strong enough to support the small tube 12 and transfer recoil forces to second base cap 22. The second base cap 22 includes a generally spherical portion 34 for mating with a mortar base plate (not shown) in a known manner. The large mortar tube 14 may comprise aluminum.

The method of making a mortar tube has been improved. In particular, the small mortar tube 12 includes an integrated BAD 26. By making the BAD 26 integral to the tube forging, several fabrication steps/operations are eliminated. This results in reduced cost of the unit and a lighter weight system, compared to the prior art. In the prior art, after fabrication, the tube and the BAD are sent to yet another fabricator, i.e., outside contractor/vendor, who then plates the interface area between the BAD and the tube as a corrosion preventative. This step alone can take weeks, as the principal fabricator has to contract this item/process outside. The cost associated with this step is approximately 25% of the entire cost to manufacture. In the present invention, the method of making the mortar tube includes forging the mortar tube to include an integral blast attenuation device.

The small mortar tube 12 advances the state-of-the art over current mortar tubes because it utilizes a separate, removable base cap 16. The separate, removable base cap 16 permits improved inspection of the firing pin area by maintenance personnel. The base cap 16 has a plurality, e.g., three centering projections 36, which allow the small tube 12 to be centered in the large tube 14 without additional parts. In contrast, the prior art assembly, e.g., M303, uses a separate welded collar/sleeve assembly. The prior art has problems with the welded collar design as the welds often fail and the collar becomes unusable, thus reducing the reliability of the prior art mortar systems. In contradistinction, the base cap 16 of the present invention comprises a unitary forging, thereby eliminating the need for welding and increasing the system's reliability.

The separate/removable base cap 16 also reduces production cost by about 50%. The separate base cap 16 eliminates the difficult machining of the blind hole common to the integrated base cap/tube design seen in the prior art barrel assemblies, e.g., M252. Current prices for the prior art barrel assembly are about $45,000/unit. The present invention's barrel assembly reduces the cost to about $22,000/unit based on current rates. Thus, the invention includes a method of making a mortar tube that includes forming a base cap 16 that is separate from the mortar tube 12. In addition, forming the base cap 16 includes forming centering projections 36 integral with the base cap 16. The method further comprises machining an interior of the mortar tube 12 without having a base cap attached to the mortar tube.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A training mortar apparatus, comprising:

a small mortar tube and a large mortar tube, the small mortar tube being disposed in the large mortar tube;

A removable base cap attached to one end of the small mortar tube;

a plug inserted in the removable base cap;

a removable firing pin inserted in the plug;

a second base cap attached to one end of the large mortar tube; and at least one opening in the large mortar tube, the opening being proximate to the removable firing pin of the small mortar tube.

2. The apparatus of claim 1 wherein the small mortar tube includes an integral blast attenuation device.

3. The apparatus of claim 2 further comprising a centering ring disposed around the small mortar tube adjacent a muzzle end of the large mortar tube.

4. The apparatus of claim 1 wherein a number of openings in the large mortar tube that are proximate to the removable firing pin is three.

5. The apparatus of claim 1 wherein the large mortar tube includes a seat for the plug of the small mortar tube.

6. The apparatus of claim 1 wherein the small mortar tube includes cooling fins.

7. The apparatus of claim 1 wherein the second base cap includes a generally spherical portion for mating with a mortar base plate.

8. The apparatus of claim 1 wherein the removable base cap of the small mortar tube includes centering projections.

9. The apparatus of claim 1 wherein the small mortar tube comprises steel.

10. The apparatus of claim 1 wherein the large mortar tube comprises aluminum.

11. The apparatus of claim 1 wherein the small mortar tube is an 81 mm tube and the large mortar tube is a 120 mm tube.

* * * * *